US007453039B2

(12) United States Patent
Ramstein

(10) Patent No.: US 7,453,039 B2
(45) Date of Patent: Nov. 18, 2008

(54) SYSTEM AND METHOD FOR PROVIDING HAPTIC FEEDBACK TO A MUSICAL INSTRUMENT

(75) Inventor: Christophe Ramstein, San Francisco, CA (US)

(73) Assignee: Immersion Corporation, San Jose, CA (US)

( * ) Notice: Subject to any disclaimer, the term of this patent is extended or adjusted under 35 U.S.C. 154(b) by 0 days.

(21) Appl. No.: 11/506,682

(22) Filed: Aug. 18, 2006

(65) Prior Publication Data

US 2006/0278065 A1 Dec. 14, 2006

(51) Int. Cl.
*G10H 7/00* (2006.01)

(52) U.S. Cl. ..... 84/645; 345/156

(58) Field of Classification Search ..... 84/645; 345/156

See application file for complete search history.

(56) References Cited

U.S. PATENT DOCUMENTS

| | | | |
|---|---|---|---|
| 3,157,853 | A | 11/1964 | Hirsch |
| 3,220,121 | A | 11/1965 | Cutler |
| 3,497,668 | A | 2/1970 | Hirsch |
| 3,517,446 | A | 6/1970 | Corlyon et al. |
| 3,902,687 | A | 9/1975 | Hightower |
| 3,903,614 | A | 9/1975 | Diamond et al. |
| 4,160,508 | A | 7/1979 | Salsbury |
| 4,236,325 | A | 12/1980 | Hall et al. |
| 4,513,235 | A | 4/1985 | Acklam et al. |
| 4,581,491 | A | 4/1986 | Boothroyd |
| 4,599,070 | A | 7/1986 | Hladky et al. |
| 4,708,656 | A | 11/1987 | De Vries et al. |
| 4,713,007 | A | 12/1987 | Alban |
| 4,891,764 | A | 1/1990 | McIntosh |
| 4,930,770 | A | 6/1990 | Baker |

(Continued)

FOREIGN PATENT DOCUMENTS

| | | |
|---|---|---|
| EP | 0349086 | 1/1990 |

(Continued)

OTHER PUBLICATIONS

Adelstein, "A Virtual Environment System For The Study of Human Arm Tremor," Ph.D. Dissertation, Dept. of Mechanical Engineering, MIT, Jun. 1989.

(Continued)

*Primary Examiner*—Jeffrey Donels
(74) *Attorney, Agent, or Firm*—Kilpatrick Stockton LLP

(57) ABSTRACT

A system and method for generating a haptic feedback signal correlated to a music signal and providing the haptic feedback signal to a musical instrument. The music signal can created by the musical instrument or from a file, e.g., a MIDI file. A processor can generate the haptic feedback signal using a look-up table in which the music signal is mapped to a corresponding haptic feedback signal or can compute the corresponding haptic feedback signal based on the parameters of the music signal. The processor provides the haptic feedback signal to an actuator for causing a haptic effect at the musical instrument in response to receiving the haptic feedback signal. The haptic feedback signal can be applied to an input member, such as a key on a keyboard or a string on a guitar, or to the housing of the musical instrument, such as the neck of a guitar.

44 Claims, 4 Drawing Sheets

U.S. PATENT DOCUMENTS

| | | | | |
|---|---|---|---|---|
| 4,934,694 | A | 6/1990 | McIntosh | |
| 5,019,761 | A | 5/1991 | Kraft | |
| 5,022,407 | A | 6/1991 | Horch et al. | |
| 5,035,242 | A | 7/1991 | Franklin | |
| 5,038,089 | A | 8/1991 | Szakaly | |
| 5,078,152 | A | 1/1992 | Bond | |
| 5,186,695 | A | 2/1993 | Mangseth et al. | |
| 5,189,242 | A * | 2/1993 | Usa | 84/743 |
| 5,212,473 | A | 5/1993 | Louis | |
| 5,240,417 | A | 8/1993 | Smithson et al. | |
| 5,271,290 | A | 12/1993 | Fischer | |
| 5,275,174 | A | 1/1994 | Cook | |
| 5,299,810 | A | 4/1994 | Pierce | |
| 5,309,140 | A | 5/1994 | Everett | |
| 5,334,027 | A | 8/1994 | Wherlock | |
| 5,466,213 | A | 11/1995 | Hogan | |
| 5,547,382 | A | 8/1996 | Yamasaki | |
| 5,766,016 | A | 6/1998 | Sinclair | |
| 5,785,630 | A | 7/1998 | Bobick et al. | |
| 6,111,577 | A | 8/2000 | Zilles et al. | |
| 6,219,034 | B1 | 4/2001 | Elbing et al. | |
| 6,422,941 | B1 | 7/2002 | Thorner et al. | |
| 2003/0068053 | A1 * | 4/2003 | Chu | 381/118 |
| 2004/0130526 | A1 * | 7/2004 | Rosenberg | 345/156 |
| 2004/0161118 | A1 * | 8/2004 | Chu | 381/61 |

FOREIGN PATENT DOCUMENTS

| | | |
|---|---|---|
| JP | 01-003664 | 7/1990 |
| JP | 02-109714 | 1/1992 |
| JP | 04-007371 | 8/1993 |
| JP | 05-193862 | 1/1995 |

OTHER PUBLICATIONS

Adelstein, "Design and Implementation of a Force Reflecting Manipulandum for Manual Control research," DSC-vol. 42, Advances in Robotics, Edited by H. Kazerooni, pp. 1-12, 1992.

Aukstakalnis et al., "Silicon Mirage: The Art and Science of Virtual Reality," ISBN 0-938151-82-7, pp. 129-180, 1992.

Baigrie, "Electric Control Loading—A Low Cost, High Performance Alternative," Proceedings, pp. 247-254, Nov. 6-8, 1990.

Bejczy et al., "Kinesthetic Coupling Between Operator and Remote Manipulator," International Computer Technology Conference, The American Society of Mechanical Engineers, San Francisco, CA, Aug. 12-15, 1980.

Bejczy, "Sensors, Controls, and Man-Machine Interface for Advanced Teleoperation," Science, vol. 208, No. 4450, pp. 1327-1335, 1980.

Bejczy, "Generalization of Bilateral Force-Reflecting Control of Manipulators," Proceedings Of Fourth CISM-IFToMM, Sep. 8-12, 1981.

Bejczy, et al., "Universal Computer Control System (UCCS) For Space Telerobots," CH2413-3/87/0000/0318501.00 1987 IEEE, 1987.

Bejczy et al., "A Laboratory Breadboard System For Dual-Arm Teleoperation," SOAR '89 Workshop, JSC, Houston, TX, Jul. 25-27, 1989.

Brooks et al., "Hand Controllers for Teleoperation—A State-of-the-Art Technology Survey and Evaluation," JPL Publication 85-11; NASA-CR-175890; N85-28559, pp. 1-84, Mar. 1, 1985.

Burdea et al., "Distributed Virtual Force Feedback, Lecture Notes for Workshop on Force Display in Virtual Environments and its Application to Robotic Teleoperation," 1993 IEEE International Conference on Robotics and Automation, pp. 25-44, May 2, 1993.

Caldwell et al., "Enhanced Tactile Feedback (Tele-Taction) Using a Multi-Functional Sensory System," 1050-4729/93, pp. 955-960, 1993.

"Cyberman Technical Specification," Logitech Cyberman Swift Supplement, Apr. 5, 1994.

Eberhardt et al., "OMAR—A Haptic display for speech perception by deaf and deaf-blind individuals," IEEE Virtual Reality Annual International Symposium, Seattle, WA, Sep. 18-22, 1993.

Eberhardt et al., "Including Dynamic Haptic Perception by The Hand: System Description and Some Results," DSC-vol. 55-1, Dynamic Systems and Control: vol. 1, ASME 1994.

Gobel et al., "Tactile Feedback Applied to Computer Mice," International Journal of Human-Computer Interaction, vol. 7, No. 1, pp. 1-24, 1995.

Gotow et al., "Controlled Impedance Test Apparatus for Studying Human Interpretation of Kinesthetic Feedback," WA11-11:00, pp. 332-337.

Howe, "A Force-Reflecting Teleoperated Hand System for the Study of Tactile Sensing in Precision Manipulation," Proceedings of the 1992 IEEE Interntional Conference on Robotics and Automation, Nice, France, May 1992.

IBM Technical Disclosure Bulletin, "Mouse Ball-Actuating Device With Force and Tactile Feedback," vol. 32, No. 98, Feb. 1990.

Iwata, "Pen-based Haptic Virtual Environment," 0-7803-1363-1/93 IEEE, pp. 287-292, 1993.

Jacobsen et al., "High Performance, Dextrous Telerobotic Manipulator With Force Reflection," Intervention/ROV '91 Conference & Exposition, Hollywood, Florida, May 21-23, 1991.

Jones et al., "A perceptual analysis of stiffness," ISSN 0014-4819 Springer International (Springer-Verlag); Experimental Brain Research, vol. 79, No. 1, pp. 150-156, 1990.

Kaczmarek et al., "Tactile Displays," Virtual Environment Technologies.

Kontarinis et al., "Display of High-Frequency Tactile Information to Teleoperators," Telemanipulator Technology and Space Telerobotics, Won S. Kim, Editor, Proc. SPIE vol. 2057, pp. 40-50, Sep. 7-9, 1993.

Marcus, "Touch Feedback in Surgery," Proceedings of Virtual Reality and Medicine The Cutting Edge, Sep. 8-11, 1994.

Mcaffee, "Teleoperator Subsystem/Telerobot Demonstrator: Force Reflecting Hand Controller Equipment Manual," JPL D-5172, pp. 1-50, A1-A36, B1-B5, C1-C36, Jan. 1988.

Minsky, "Computational Haptics: The Sandpaper System for Synthesizing Texture for a Force-Feedback Display," Ph.D. Dissertation, MIT, Jun. 1995.

Ouh-Young, "Force Display in Molecular Docking," Order No. 9034744, p. 1-369, 1990.

Ouh-Young, "A Low-Cost Force Feedback Joystick and Its Use in PC Video Games," IEEE Transactions on Consumer Electronics, vol. 41, No. 3, Aug. 1995.

Ohyoung et al., "The Development of A Low-Cost Force Feedback Joystick and Its Use in the Virtual Reality Environment," Proceedings of the Third Pacific Conference on Computer Graphics and Applications, Pacific Graphics '95, Seoul, Korea, Aug. 21-24, 1995.

Patrick et al., "Design and Testing of a Non-reactive, Fingertip, Tactile Display for Interaction with Remote Environments," Cooperative Intelligent Robotics in Space, Rui J. deFigueiredo et al., Editor, Proc. SPIE vol. 1387, pp. 215-222, 1990.

Pimentel et al., "Virtual Reality: through the new looking glass," 2nd Edition; McGraw-Hill, ISBN 0-07-050167-X, pp. 41-202, 1994.

Rabinowitz et al., "Multidimensional tactile displays: Identification of vibratory intensity, frequency, and contactor area," Journal of The Acoustical Society of America, vol. 82, No. 4, Oct. 1987.

Russo, "The Design and Implementation of a Three Degree of Freedom Force Output Joystick," MIT Libraries Archives Aug. 14, 1990, pp. 1-131, May 1990.

Russo, "Controlling Dissipative Magnetic Particle Brakes in Force Reflective Devices," DSC-vol. 42, Advances in Robotics, pp. 63-70, ASME 1992.

Scannell, "Taking a Joystick Ride," Computer Currents, Boston Edition, vol. 9, No. 11, Nov. 1994.

Shimoga, "Finger Force and Touch Feedback Issues in Dexterous Telemanipulation," Proceedings of Fourth Annual Conference on Intelligent Robotic Systems for Space Exploration, Rensselaer Polytechnic Institute, Sep. 30-Oct. 1, 1992.

Snow et al., "Model-X Force-Reflecting-Hand-Controller," NT Control No. MPO-17851; JPL Case No. 5348, pp. 1-4, Jun. 15, 1989.

Stanley et al., "Computer Simulation of Interacting Dynamic Mechanical Systems Using Distributed Memory Parallel Processors," DSC-vol. 42, Advances in Robotics, pp. 55-61, ASME 1992.
Tadros, "Control System Design for a Three Degree of Freedom Virtual Environment Simulator Using Motor/Brake Pair Actuators", MIT Archive © Massachusetts Institute of Technology, pp. 1-88, Feb. 1990.
Terry et al., "Tactile Feedback In A Computer Mouse," Proceedings of Fourteenth Annual Northeast Bioengineering Conference, University of New Hampshire, Mar. 10-11, 1988.

* cited by examiner

SYSTEM AND METHOD FOR PROVIDING HAPTIC FEEDBACK TO A MUSICAL INSTRUMENT

CROSS-REFERENCE TO RELATED APPLICATIONS

This application is a continuation of U.S. patent application Ser. No. 10/891,227, now U.S. Pat. No. 7,112,737, entitled "System and Method for Providing a Haptic Effect to a Musical Instrument," filed Jul. 15, 2004, which claims priority to U.S. Provisional Application No. 60/533,671 filed Dec. 31, 2003, the entire disclosures of which are incorporated herein by reference.

NOTICE OF COPYRIGHT PROTECTION

A portion of the disclosure of this patent document and its figures contains material subject to copyright protection. The copyright owner has no objection to the facsimile reproduction by anyone of the patent document, but otherwise reserves all copyrights whatsoever.

FIELD OF THE INVENTION

The present invention generally relates to providing a haptic effect. The present invention more particularly relates to providing a haptic effect to a musical instrument.

BACKGROUND

Designers and manufacturers of musical equipment, such as electronic pianos, are constantly striving to improve the musical equipment. For example, designers and manufacturers continue striving to make electronic instruments perform and feel like non-electronic musical instruments. One difference between electronic instruments and non-electronic instruments is that many electronic instruments typically provide little to no realistic haptic effects. As a result, musicians playing many electronic instruments can only hear the music and cannot feel a satisfactory response to the music. In other words, pressing down on a key on an electronic keyboard feels differently than pressing down on a key on a piano, as there is generally no appreciable vibration from the key on the electronic keyboard and/or no appreciable resistance from the key on the electronic keyboard that is usable in an effective manner by most users of electronic musical instruments.

Another area for improvement is teaching musical instruments. Traditionally, a student watches a teacher play an instrument, and the student learns visual and acoustically. Piano lessons are typically taught with a student sitting next to a teacher with the teacher playing the piano thus demonstrating how to play a particular melody. Since the student does not have their fingers on the keyboard, the student cannot feel haptic feedback on the keys of the piano. Thus, the student cannot feel, in an effective and efficient manner, the instructor pressing down harder on one key than the other keys.

Thus, a need exists for methods and systems for providing haptic effects to a musical instrument.

SUMMARY

Embodiments of the present invention provide systems and methods for providing a signal associated with a haptic effect to a musical instrument. In one embodiment, a processor can receive a first signal having a set of parameters relating to sound, select a haptic effect from one or more look-up tables using at least one predetermined parameter from the set of parameters, and output a second signal associated with the haptic effect. In another embodiment, the processor can receive a first signal having a set of parameters relating to sound, compute a haptic effect using at least one predetermined parameter from the set of parameters, and output a second signal associated with the haptic effect. The first signal can come from a variety of sources including, but not limited to, a musical instrument, a wireless medium (over the air) or a file stored in memory, e.g., a MIDI file. In one embodiment, the second signal can be provided to one or more actuators, which provide the haptic effect to the musical instrument. In one such embodiment, the haptic effect is provided to the input member that caused the first signal to be generated. In still another embodiment, the haptic effect can be provided to the housing of the musical instrument that caused the music signal to be generated. In another embodiment, the haptic effect is provided to the musical instrument simultaneously with the music being amplified, so that the musician can hear and feel the music that he or she is creating. In yet another embodiment, the haptic effect is provided to a musical instrument which did not cause the first signal to be generated.

BRIEF DESCRIPTION OF THE DRAWINGS

These and other features, aspects, and advantages of the present invention are better understood when the following Detailed Description is read with reference to the accompanying drawings, which constitute part of this specification.

DETAILED DESCRIPTION

Embodiments of this invention are described herein in the context of musical instruments. Embodiments of the invention can also be used in other contexts such as cell phones, PDAs, game controllers, surgical simulators, or any other system or method employing haptic effects. The phrase MIDI signal refers to signals using the MIDI protocol. MIDI signals refer to signals generated in accordance with the MIDI protocol, e.g., MIDI messages. Although, the detailed description uses MIDI signals/protocol as an example, other signals and/or protocols such as the mLAN protocol developed by the Yamaha Corporation of America can be utilized in accordance with embodiments of the present invention.

Figure 1:
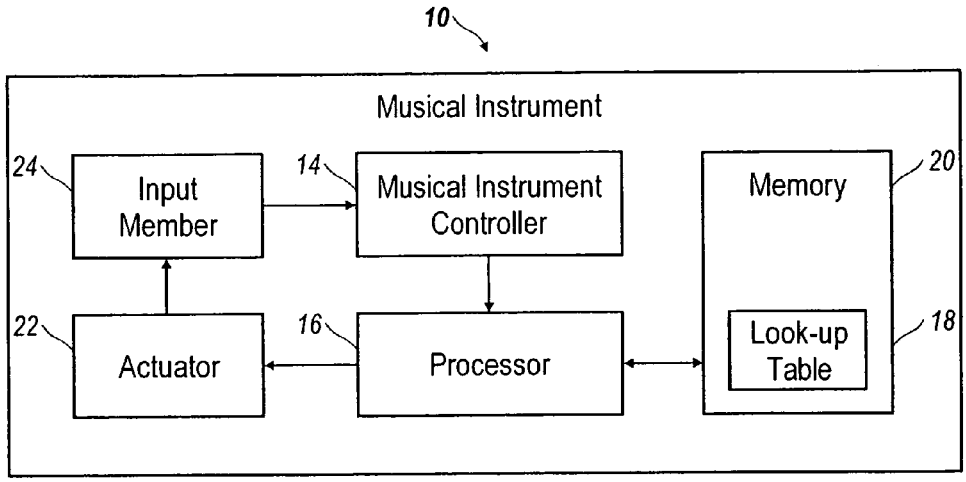
FIG. 1 is a block diagram of an exemplary system for providing a signal associated with a haptic effect to a musical instrument in accordance with an embodiment of the present invention.
Figure 2A:
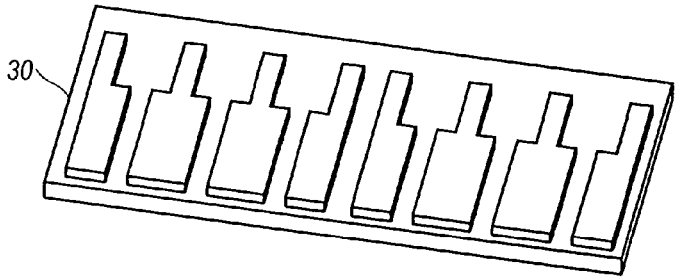
FIGS. 2A-2E are different views of exemplary instruments in accordance with different embodiments of the present invention.
Figure 2B:
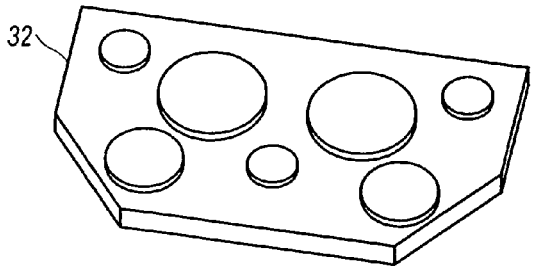
Figure 2D:
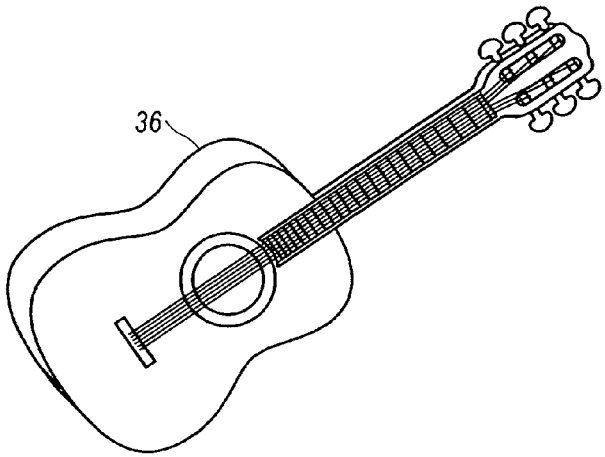
Figure 2C:
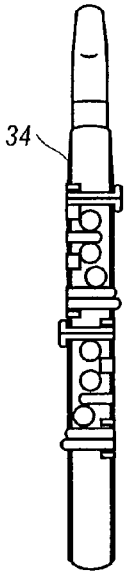
Figure 2E:
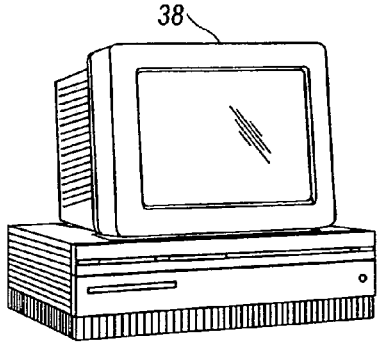

Referring now to the drawings in which like numerals indicate like elements throughout the several figures, FIG. 1 illustrates a block diagram of an exemplary system 10 for providing a signal associated with a haptic effect to a musical instrument in accordance with one embodiment of the present invention. As shown in FIG. 1, the system 10 comprises a musical instrument 12. The musical instrument can include a keyboard 30 (FIG. 2A), a drum pad 32 (FIG. 2B), a wind controller 34 (FIG. 2C), a guitar 36 (FIG. 2D), a computer 38 (FIG. 2E) configured to produce music, or any suitable musical instrument.

Referring to FIG. 1 again, the musical instrument 12 can further include a musical instrument controller 18 configured to generate a first signal having a set of parameters relating to sound. The first signal can be, but is not limited to, a music signal, a MIDI signal, or other signals as known in the art. Examples of the parameters relating to sounds can include, but are not limited to, start, delay, duration, waveform, frequency, magnitude, and envelope (attack time, attack level, fade time, fade level, etc.). Some of the parameters can be time varying. The parameters can be MIDI parameters and can include, but are not limited to, MIDI note number, note velocity, note duration, note volume, channel number, patch number, MIDI notes, or another parameter or variable that can be associated with a MIDI signal.

The musical instrument controller 18 can generate one or more first signals in response to a musician playing the musical instrument 12 as known in the art. For example, the music instrument controller 18 can generate a first signal in response to a musician actuating an input member 24 on the musical instrument 12, such as pressing down on a key on a keyboard or strumming a guitar string on a guitar. An input member 24 comprises a member associated with sound, music, or a musical instrument that can be actuated directly or indirectly by a user. Examples include, as mentioned, a keyboard key or a guitar string. Examples also include a computer-keyboard key, or another type of key or button. When an input member 24 is actuated, a sensor can detect the event and send one or more sensor signals to the musical instrument controller 14. The musical instrument controller 14 can be configured to generate one or more first signals in response to receiving the one or more sensor signals. In another embodiment, the musical instrument controller 18 can be configured to generate one or more first signals, e.g., MIDI signals, in response to reading a file, e.g., a MIDI file, stored in memory 20. The file can be correlated to various events as known in the art. In yet another embodiment, the music instrument controller 14 can receive the first signal from the musical instrument 12 via a microphone (not shown).

The system 10 can further include a processor 16 configured to receive a first signal, e.g., a MIDI signal, and determine one or more haptic effects, which are correlated to the first signal. The processor 16 is configured to execute computer-executable program instructions stored in memory 20. Such processors can include any combination of one or more microprocessors, ASICs, and state machines. Such processors include, or can be in communication with, media, for example computer-readable media 20, which stores instructions that, when executed by the processor, cause the processor to perform the steps described herein. Embodiments of computer-readable media include, but are not limited to, an electronic, optical, magnetic, or other storage or transmission device capable of providing a processor with computer-readable instructions. Other examples of suitable media include, but are not limited to, a floppy disk, CD-ROM, DVD, magnetic disk, memory chip, ROM, RAM, an ASIC, a configured processor, all optical media, all magnetic tape or other magnetic media, or any other medium from which a computer processor can read instructions. Also, various other forms of computer-readable media can transmit or carry instructions to a computer, including a router, private or public network, or other transmission device or channel, both wired and wireless. The instructions can comprise code from any suitable computer-programming language, including, for example, C, C+, C++, Visual Basic, Java, Python, and JavaScript. The controller 14 shown in FIG. 1 can comprise such a processor.

Referring still to FIG. 1, the processor 16 can be configured to receive the first signal having a set of parameters relating to sound and to generate a second signal associated with a haptic effect. In one embodiment, the processor 16 can use one or more look-up tables 18 stored in memory 20 to determine the haptic effect corresponding to the first signal, e.g., MIDI signal. The look-up tables 18 can be stored in a database which can be stored in memory 20. The look-up tables 18 can be pre-programmed by the manufacturer of the musical instrument, provided as a third-party add-on to the instrument, provided as a stand-alone module, programmed by the user or a third party, or provided in any other suitable manner. In one embodiment, the look-up tables 18 contain parameters relating to sound which are mapped to zero or more haptic effects, with the haptic effects being controlled by the parameters associated with the sound. In other embodiments, including the embodiment shown in FIG. 1, signals having parameters, e.g., MIDI signals, are mapped to haptic effects and can be based on a predetermined parameters, e.g., the note number, such as a MIDI note number, note velocity, note duration, note volume, channel number, patch number, notes, MIDI notes, or another parameter or variable that can be associated with a first signal. As a result, the haptic effect can correlate to, for example, the characteristics of the input from the musician.

In another embodiment, the processor 16 can be configured to compute the second signal based on the first signal, e.g. MIDI signal. For example, the second signal can be computed as a waveform based on attributes of a predetermined parameter, e.g., a MIDI note. Some of the attributes controlling the second signal can be pre-defined and selectable by particular combinations of MIDI signals, while other attributes can be computed from the first signal. For example, the patch number for a note can select a specific communication of waveform and envelope parameters while the note number and duration can modify the frequency, magnitude and envelope parameters. The resulting haptic effect frequency can be different from the MIDI signal frequency.

Referring again to FIG. 1, the system 10 can further include one or more actuators 22 configured to receive the second signal and provide the associated haptic effect to one or more input members 24 or to a surface or the housing of the musical instrument 12. The haptic effects can be kinesthetic feedback (such as, without limitation, active and resistive force feedback), and/or tactile feedback (such as, without limitation, vibration, texture, and heat). The haptic effect and the amplification of the music can be synchronized.

One or more actuators 22 can be coupled to a corresponding input member 24. In one embodiment, each input member 24 can be coupled to a corresponding actuator 22. In one embodiment, the one or more haptic effects can be provided to the input member 24 which caused the first signal to be generated. For example, the haptic effect is provided to a keyboard key that the musician has pressed down, or to a guitar string that the musician strummed. In yet another embodiment, the one or more haptic effects can be provided to the input member 24 which caused the first signal to be generated and to one or more input members 24 which correspond to the input member 24 which caused the generation of the first signal with the corresponding input member or members being on a different scale. For example, if a teacher presses down on a key on a electronic keyboard, the haptic effect is provided to the key that was pressed down and one or more corresponding keys on one or more different scales. In such an embodiment, a student could feel the haptic effect on a corresponding key.

In one embodiment, one or more actuators 22 are coupled to a surface or housing of a musical instrument 12 and apply the one or more haptic effects to the surface or housing of the musical instrument 12 with one or more haptic effects being associated with one or more first signals. For example, one or more actuators 22 are coupled to the body or neck of a guitar, the body of a wind instrument, or to the drum pad of a drum.

Various types of actuators can be utilized in different embodiments of the present invention. These actuators can provide any combination of vibrational feedback, force feedback, resistive feedback, or any kind of haptic feedback appropriate for a given effect. For example, in one embodiment, a motor can provide a rotational force. In another embodiment, a motor can drive a belt that is configured to produce a rotational force directly or indirectly on an input member 24 or to the housing of a musical instrument 12. In yet another embodiment, a motor can be connected to a flexure, such as a brass flexure, which produces rotational force on the input device. Exemplary actuators are described in further detail in PCT Patent Application No. PCT/US03/33202 having an international filing date of Oct. 20, 2003, the entire disclosure of which incorporated herein by reference.

Figure 3:
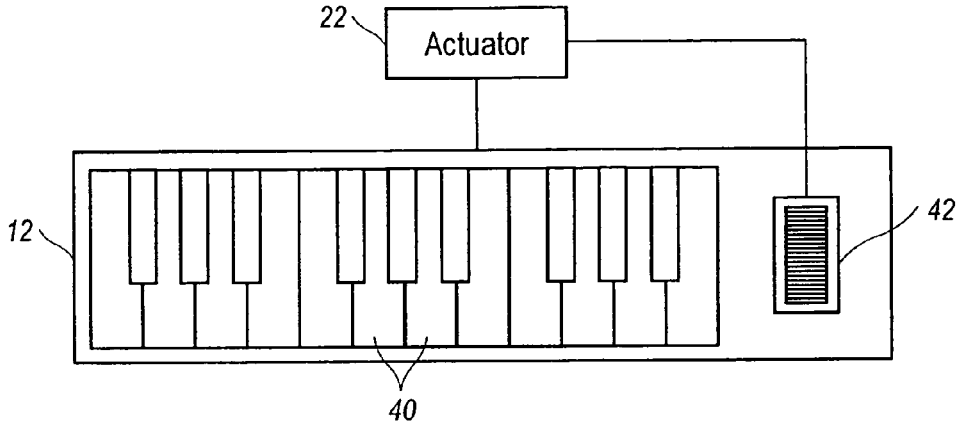
FIG. 3 is a perspective view of keys on a keyboard and a pitch bend having an associated actuator in accordance with an embodiment of the present invention.

Referring to FIG. 3, a perspective view of a keyboard in accordance with an exemplary embodiment of the present invention is illustrated. As shown, the keyboard 12 includes a plurality of input members—keys 40 and a rotary control 42 (e.g., a pitch bend) with one or more actuators 22 providing the one or more haptic effects to the input members 40, 42. The pitch bend 42 produces a change in pitch in response to the movement of a pitch bend wheel or lever. The actuator 22 can provide the haptic effect in the form of kinesthetic feedback in response to the movement of the pitch bend 42 or can provide a haptic effect in the form of tactile feedback in response to the effect of the movement of the pitch bend 42 as described above. Exemplary actuators that can provide resistance for a pitch bend are described in further detail in U.S. patent application Ser. No. 10/314,400 having a filing date of Dec. 8, 2002, the entire disclosure of which incorporated herein by reference.

Similarly, one or more actuators 22 can provide the haptic effect to a pitch bend arm on a guitar (not shown). The actuators 22 can provide the haptic effect in the form of kinesthetic feedback in response to the movement of the pitch bend arm or can provide a haptic effect in the form of tactile feedback in response to the effect of the movement of the pitch bend arm as described above.

Figure 4:
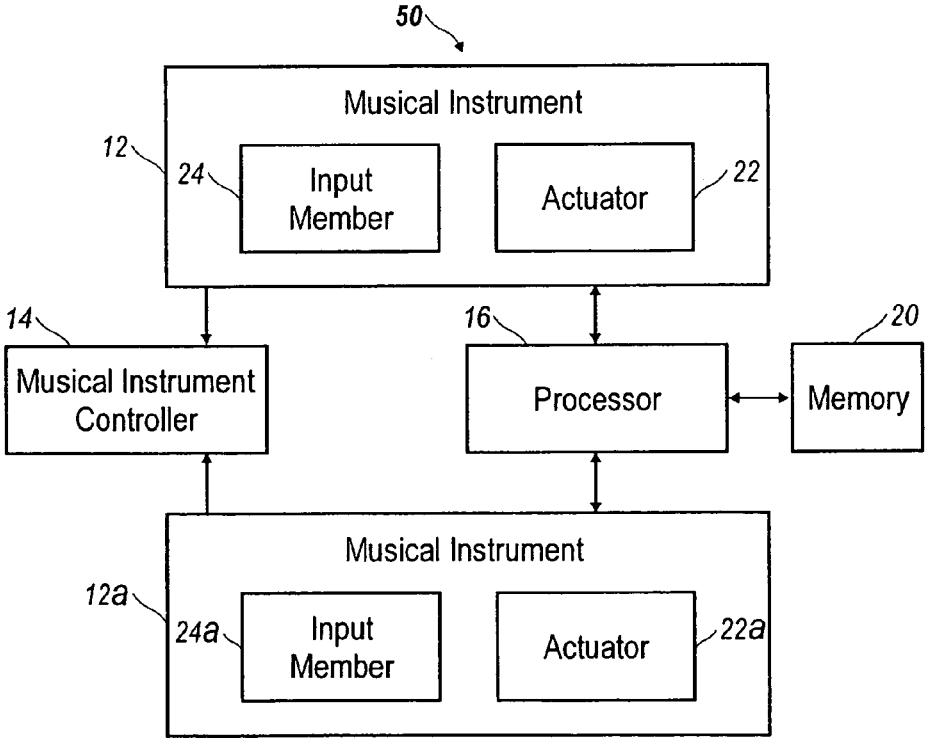
FIG. 4 is a block diagram of an exemplary system for providing a signal associated with a haptic effect to a musical instrument in accordance with an embodiment of the present invention.

Referring to FIG. 4, a block diagram of an exemplary system 50 for providing a signal associated with a haptic effect to a musical instrument in accordance with an embodiment of the present invention is illustrated. As shown in FIG. 4, the system 50 includes a musical instrument 12, a musical instrument controller 14, and a processor 16 with each being an individual component. In an alternate embodiment, the music instrument controller 14 can be part of the musical instrument 12. In another alternate embodiment, the music instrument controller 14 and the processor 16 can be combined.

As shown in FIG. 4, the musical instrument controller 14 is separate from the musical instrument 12 and can be a pickup controller for the musical instrument 12, e.g., a pick-up controller for a guitar. In one embodiment, the musical instrument controller 14 can be configured to receive sensor signals based on user input, e.g., a musician pressing a key on a keyboard or strumming the string on a guitar. The musical instrument controller 14 can be configured to generate one or more first signals based on the sensor signals. In another embodiment, the musical instrument controller 14 can be configured to generate one or more first signals, e.g., MIDI signals, in response to reading a file, e.g., a MIDI file, stored in memory 20. The file can be correlated to various events as known in the art. The processor 16 is configured to generate second signals associated with one or more haptic effects correlated to the one or more first signals.

In another embodiment, the processor 16 can be configured to receive one or more first signals from the musical instrument 12 either directly or via a wireless connection. In this other embodiment, the processor 16 does not require the use of a musical instrument controller 14. Hence, the processor 16 can receive one or more first signals and generate one or more second signals associated with one or more haptic effects correlated to the one or more first signals. For example, the musical instrument 12 can be a player piano, in which the stored signals are reproduced on the player piano, e.g., the player's touch timing, velocity, duration and release.

In yet another embodiment, the system 10, 50 can include more than one musical instrument 12. For example, as shown in FIG. 4, a first instrument 12 and a second instrument 12*a* can be coupled with the processor 16 being configured to receive one or more first signals from one of the musical instruments 12, 12*a* and/or from one or more first signals stored in memory 20. The processor 16 can be configured to convert the one or more first signals into one or more second signals which are provided to one or more of the coupled musical instruments, e.g., the first musical instrument 12 and/or the second musical instrument 12*a*. In addition, the musical instruments 12, 12*a* can be different instruments. For example, the first musical instrument 12 can be a guitar and the second musical instrument 12*a* can be a keyboard. In embodiments in which the second signal is being provided to a musical instrument which caused the first signal, the second signal can be referred to as a haptic feedback signal. For example, if two musical instruments are coupled via the processor 16, the musical instrument 12, 12*a* that caused the music signal can receive the haptic feedback signal and the other musical instrument 12*a*, 12 would receive a second signal which matches the haptic feedback signal. If the two musical instruments 12, 12*a* are different musical instruments, then the haptic effect can be provided to an input member 24 corresponding to the input member 24 which generated the first signal.

Figure 5:
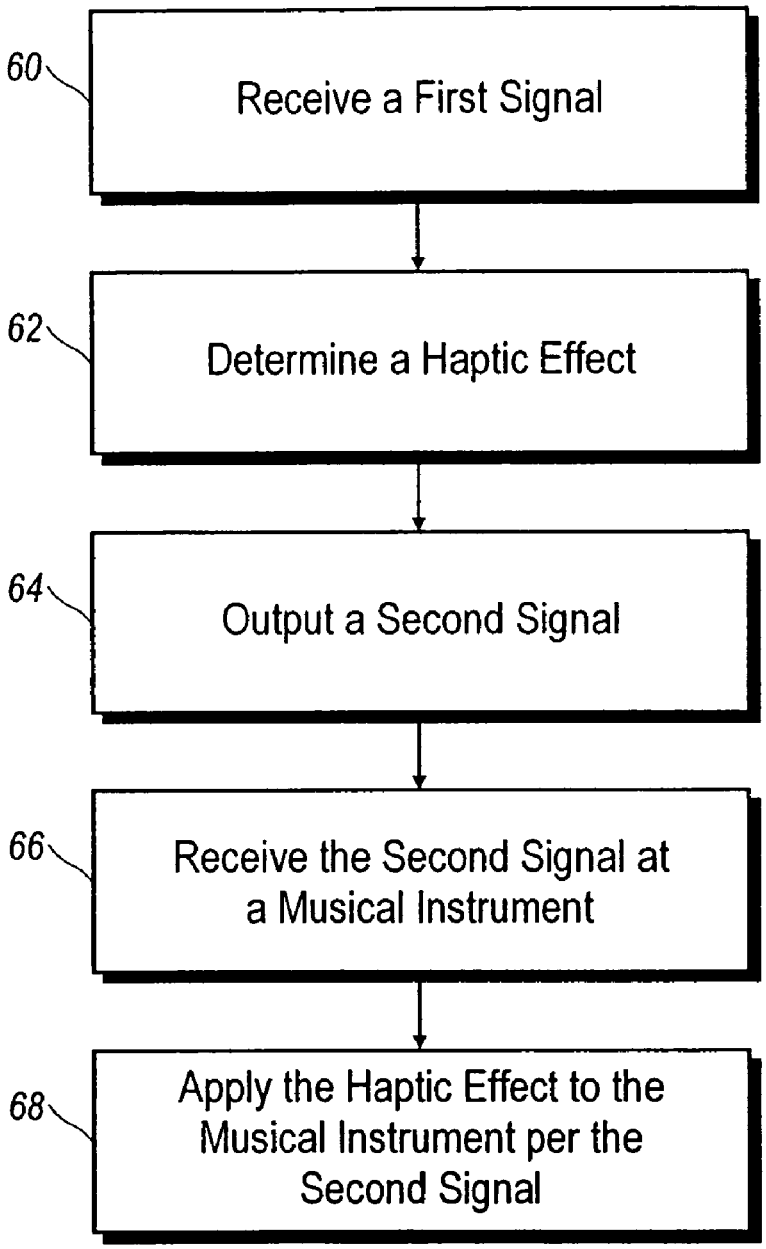
FIG. 5 is a flowchart, illustrating a flow of information between various modules of the firmware in an embodiment of the present invention.

Referring to FIG. 5, a method utilizing an embodiment of the present invention is illustrated. The method can start with a processor 16 receiving a first signal 60. The first signal can be from a sensor detecting a musician playing the instrument, from a memory, from a stored file, e.g., a MIDI file, from another instrument, via a wireless connection, or from any other medium known in the art. The processor 16 receives the first signal and generates one or more second signals associated with one or more haptic effects that correlate to the first signal 62. This can include the processor 16 accessing a look-up table to determine the mapped haptic effect correlated to the first signal or can compute the second signal associated with one or more haptic effects correlated to the first signal. The processor 16 outputs the second signal 64. One or more musical instruments 12 receive the second signal 66. A haptic effect is applied to the musical instrument according to the second signal 68. For example, a local processor (not shown) in the musical instrument 12 can receive the second signal and provide an actuation signal to one or more corresponding actuators 22. The actuation signal comprises an indication that the actuator 22 should actuate (e.g.

vibrate or provide resistance). The communication between the actuator 22 and the one or more input members 24 can be configured such that the actuator's actuation provides haptic feedback (e.g., in the form of vibrations or resistance) to the one or more input members 24. In other embodiments, this step can comprise the one or more actuators 22 receiving the second signal from the processor 16 and then actuating to provide the haptic effect to one or more input members 24. The one or more actuators 22 can provide different haptic effects based on the second signal or actuation signal. For example, different haptic effects can be provided by regulating the current delivered to an actuator 22, the duration of the current delivered to an actuator 22, the time cycles between cycles of energizing an actuator 22, and the number of cycles of energizing an actuator 22. These conditions can be varied to produce a variety of haptic effects. The haptic effect can be applied to an input member 24 that caused the first signal, for example a key on a keyboard being pressed down or a string on a guitar being strummed. Alternately, the haptic effect can be applied to the surface or the housing of the musical instrument 12, such as the neck of a guitar. In another embodiment, the haptic effect can be applied to one or more musical instruments 12.

The foregoing description of the preferred embodiments of the invention has been presented only for the purpose of illustration and description and is not intended to be exhaustive or to limit the invention to the precise forms disclosed. Numerous modifications and adaptations thereof will be apparent to those skilled in the art without departing from the spirit and scope of the present invention.

What is claimed is:

1. A system comprising:

a database comprising at least one haptic effect; and a processor in communication with the database and a musical instrument having at least one actuator, the processor configured to:

read sound data from a data source stored in a computer-readable medium;

receive a selection of a haptic effect in the database, the haptic effect associated with the sound data;

transmit the sound data to the musical instrument to cause an output of a sound; and transmit an actuator signal to the at least one actuator, the actuator signal configured to cause the at least one actuator to output the haptic effect to the musical instrument while the instrument is being played, the output of the haptic effect corresponding to the output of the sound.

2. The system of claim 1 wherein the database comprises at least one look-up table comprising the at least one haptic effect.

3. The system of claim 1 wherein the processor is configured to read the sound data by reading the sound data from a file.

4. The system of claim 3 wherein the file is a musical instrument digital interface (MIDI) file.

5. The system of claim 1 wherein the actuator is configured to cause the haptic effect on an input member of the musical instrument.

6. The system of claim 5 wherein the musical instrument is a keyboard-based instrument, and the input member is selected from the group consisting of a key and a pitch bend.

7. The system of claim 1 wherein the musical instrument comprises a housing and wherein the actuator is coupled to the housing and configured to cause the haptic effect on the housing.

8. The system of claim 1 further comprising a musical instrument selected from the group consisting of a keyboard, drum pads, wind controller, guitar, electric guitar, and a computer.

9. The system of claim 1, wherein the sound data comprises one note, and the haptic effect is correlated to the one note.

10. The system of claim 1, wherein the sound data comprises a chord, and the haptic effect is correlated to the chord.

11. The system of claim 1, wherein the first musical instrument comprises a guitar, and the input member comprises a guitar string.

12. A computer-readable medium on which is encoded processor-executable program code to cause a processor to execute one or more instructions, the computer-readable medium comprising:

program code to read sound data from a data source on a first computer-readable medium;

program code to select a haptic effect from a database, the haptic effect associated with the sound data;

program code to transmit the sound data to a musical instrument having at least One actuator to cause a sound; and program code to transmit an actuator signal to the at least one actuator, the actuator signal configured to cause the actuator to output the haptic effect to the musical instrument while the instrument is being played, the output of the haptic effect corresponding to the output of the sound.

13. The computer-readable medium of claim 12 wherein the database comprises at least one look-up table comprising the at least one haptic effect.

14. The computer-readable medium of claim 12 wherein the actuator signal is configured to cause the haptic effect on an input member of the musical instrument.

15. The computer-readable medium of claim 12 wherein the actuator signal is configured to cause the haptic effect on a housing of the musical instrument.

16. The computer readable medium of claim 12 wherein the sound data is stored in a file.

17. The computer-readable medium of claim 16 wherein the file is a musical instrument digital interface (MIDI) file.

18. The computer-readable medium of claim 12 wherein the musical instrument is a keyboard-based instrument, and comprises an input member selected from the group consisting of a key and a pitch bend.

19. The computer-readable medium of claim 12 wherein the at least one actuator is coupled to a housing of the musical instrument and is configured to cause the haptic effect on the housing.

20. The computer-readable medium of claim 12 wherein the musical instrument is selected from the group consisting of a keyboard, drum pads, wind controller, guitar, electric guitar, and a computer.

21. A method comprising:

reading sound data from a computer-readable medium;

receive a selection of a haptic effect from the database, the haptic effect associated with the sound data;

transmitting the sound data to a musical instrument having at least one actuator to cause a sound; and transmit an actuator signal to the at least one actuator, the actuator signal configured to cause the at least one actuator to output the haptic effect to the musical instrument while the instrument is being played, the output of the haptic effect corresponding to the output of the sound.

22. The method of claim 21 further comprising the step of reading the sound data from a file.

23. The method of claim 21 wherein the actuator signal is configured to cause the haptic effect on an input member of the musical instrument.

24. The method of claim 21 wherein the actuator signal is configured to cause the haptic effect on a housing of the musical instrument.

25. A system, comprising:

a database comprising at least one haptic effect;

a processor in communication with a first musical instrument and a second musical instrument, the processor configured to:

receive a first signal from the first musical instrument, the first signal generated by a manipulation of a first input member of the first musical instrument;

select a haptic effect from the database;

transmit an actuator signal to an actuator in communication with the second musical instrument to cause the actuator to output the haptic effect to the second musical instrument in response to the first signal.

26. The system of claim 25, wherein the database comprises a look-up table comprising the at least one haptic effect.

27. The system of claim 25, wherein the processor is further configured to transmit a second signal to the second instrument, the second signal based at least in part on the first signal and configured to cause the second instrument to output a sound.

28. The system of claim 27, wherein the second signal comprises a MIDI signal.

29. The system of claim 25, wherein the actuator signal is further configured to cause the actuator to output the haptic effect to an input member of the second instrument.

30. The system of claim 25, wherein the actuator signal is further configured to cause the actuator to output the haptic effect to a housing of the second instrument.

31. The system of claim 25, wherein the second musical instrument comprises a plurality of actuators.

32. The system of claim 25, wherein the actuator signal is further configured to cause the actuator to output the haptic effect to an input member of the second instrument.

33. The system of claim 32, wherein the actuator signal is further configured to cause the actuator to output the haptic effect to a housing of the second instrument.

34. The system of claim 32, wherein the processor is further configured to output a second actuator signal to a second actuator in communication with the first instrument, the second actuator signal configured to cause the haptic effect on the first instrument.

35. The system of claim 33, wherein the actuator is configured to output the haptic effect on the first input member.

36. The system of claim 33, wherein the actuator is configured to output the haptic effect on a housing of the first musical instrument.

37. A method, comprising:

receiving a first signal from a first musical instrument, the first signal generated by a manipulation of a first input member of the first musical instrument;

selecting a haptic effect from the database;

transmit an actuator signal to an actuator in communication with a second musical instrument to cause the actuator to output the haptic effect to the second musical instrument in response to the first signal.

38. The method of claim 37, wherein the actuator signal is further configured to cause the actuator to output the haptic effect to an input member of the second instrument.

39. The method of claim 38, wherein the actuator signal is further configured to cause the actuator to output the haptic effect to a housing of the second instrument.

40. The method of claim 38, wherein the processor is further configured to output a second actuator signal to a second actuator in communication with the first instrument, the second actuator signal configured to cause the haptic effect on the first instrument.

41. A computer-readable medium comprising program code, the program code comprising:

program code for receiving a first signal from a first musical instrument, the first signal generated by a manipulation of a first input member of the first musical instrument;

program code for selecting a haptic effect from the database;

program code for transmit an actuator signal to an actuator in communication with a second musical instrument to cause the actuator to output the haptic effect to the second musical instrument in response to the first signal.

42. The method of claim 41, wherein the actuator signal is further configured to cause the actuator to output the haptic effect to an input member of the second instrument.

43. The method of claim 42, wherein the actuator signal is further configured to cause the actuator to output the haptic effect to a housing of the second instrument.

44. The method of claim 42, wherein the processor is further configured to output a second actuator signal to a second actuator in communication with the first instrument, the second actuator signal configured to cause the haptic effect on the first instrument.

* * * * *